US008252430B2

(12) United States Patent
Harada et al.

(10) Patent No.: US 8,252,430 B2
(45) **Date of Patent: *Aug. 28, 2012**

(54) HEAT-RESISTANT MEMBER

(75) Inventors: Hiroshi Harada, Ibaraki (JP); Kyoko Kawagishi, Ibaraki (JP); Akihiro Sato, Ibaraki (JP)

(73) Assignee: National Institute for Materials Science, Ibaraki (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/310,911

(22) PCT Filed: Sep. 13, 2007

(86) PCT No.: PCT/JP2007/067888

§ 371 (c)(1), (2), (4) Date: May 28, 2009

(87) PCT Pub. No.: WO2008/032806

PCT Pub. Date: Mar. 20, 2008

(65) Prior Publication Data

US 2009/0274928 A1 Nov. 5, 2009

(30) Foreign Application Priority Data

Sep. 13, 2006 (JP) ..... 2006-247585

(51) Int. Cl.
*B32B 15/04* (2006.01)
*B32B 15/20* (2006.01)

(52) U.S. Cl. ..... 428/680; 428/610; 428/335; 428/336

(58) Field of Classification Search ..... 428/610, 428/680, 335, 336, 457, 650, 652, 670, 666, 428/667, 220

See application file for complete search history.

(56) References Cited

U.S. PATENT DOCUMENTS

| | | | | |
|---|---|---|---|---|
| 5,316,866 | A | 5/1994 | Goldman et al. | |
| 2004/0096690 | A1* | 5/2004 | Kelly et al. | 428/632 |
| 2004/0229075 | A1* | 11/2004 | Gleeson et al. | 428/629 |
| 2006/0093850 | A1* | 5/2006 | Darolia et al. | 428/680 |
| 2006/0093851 | A1* | 5/2006 | Darolia et al. | 428/680 |
| 2008/0226937 | A1* | 9/2008 | Harada et al. | 428/680 |

FOREIGN PATENT DOCUMENTS

| | | |
|---|---|---|
| EP | 0 207 874 | 1/1987 |
| JP | 58-93585 | 6/1983 |
| JP | 62-30037 | 2/1987 |
| JP | 5-132751 | 5/1993 |
| JP | 9-170402 | 6/1997 |

OTHER PUBLICATIONS

Kawagishi et al. in "Development of Oxidation-Resistant Beta-Phase EQ Coating System for Ni-Base Superalloys," J. Japan Inst. Metals, vol. 70, No. 2 (Feb. 2006), pp. 188-191.*

Translation of Kawagishi et al., "Development of Oxidation Resistant Beta-Phase EQ Coating System for Ni-Base Super-Alloys,"in J. Japan Inst. Metals, vol. 70(2), 188-191, Feb. 2006.*

International Search Report issued Dec. 3, 2007 in the International (PCT) Application of which the present application is the U.S. National Stage.

* cited by examiner

*Primary Examiner* — Michael La Villa

(74) *Attorney, Agent, or Firm* — Wenderoth, Lind & Ponack, LLP.

(57) ABSTRACT

A heat-resistant member is provided that includes a Ni-base superalloy substrate coated with at least one substance. The substrate and the substance are formed of materials that are substantially in a state of thermodynamic equilibrium, or in a state similar to a state of thermodynamic equilibrium, so that interdiffusion is suppressed. The heat-resistant member therefore inhibits interdiffusion of elements at the substrate/coating interface even at elevated temperatures of 1,100° C. and higher.

4 Claims, 11 Drawing Sheets

(A) CONVENTIONAL TECHNIQUE 1

(B) EXAMPLE 1

(A) CONVENTIONAL TECHNIQUE 1

(B) EXAMPLE 1

CONVENTIONAL TECHNIQUE 12 EXAMPLE 39

CONVENTIONAL TECHNIQUE 11 EXAMPLE 38

HEAT-RESISTANT MEMBER

This application is a U.S. national stage of International Application No. PCT/JP2007/067888, filed Sep. 13, 2007.

TECHNICAL FIELD

The present invention relates to heat-resistant members.

BACKGROUND ART

Al, Cr, Ni—Al, Pt—Al, MCrAlY are well-known examples of oxidation-resistant, anticorrosion coating materials commonly used for the turbine rotor blades and turbine stator vanes of many jet engines and industrial gas turbines. When these coating materials are used for the turbine blades made of a Ni-base superalloy, interdiffusion of elements proceeds at the interface between the Ni-base superalloy and the coating material upon extended use of the turbine blades at high temperatures. The element interdiffusion degrades the material of the Ni-base superalloy, which causes various technical problems such as degradation of strength and degradation of the environment resistance of the coating material. These can be detrimental to the durability of the turbine blade itself. Such a diffusion phenomenon is accelerated at the high gas temperatures of the recent jet engines and gas turbines, because the increased gas temperature inevitably raises the temperature of the turbine blades. The adverse effect of the diffusion region becomes even more problematic with the reducing thickness of high-pressure turbine blades, which have a hollow construction for cooling.

A diffusion barrier coating has been proposed that suppresses element diffusion at the substrate/coating interface (see, for example, Patent Document 1). The limitation of the diffusion barrier coating, however, is that it is a multilayer structure and therefore complicates the coating process, and that the substrate and the coating material are not in a state of thermodynamic equilibrium.

The recently published U.S. Patent Application 2004/0229075 (Patent Document 2) discloses limiting Al diffusion using a γ+γ' phase coating that contains a Pt-group metal with a reduced concentration of Al, which is the fastest diffusing element and generates a deleterious phase by diffusion. However, as above, the effect is still limited because the substrate and the coating material are not in a state of thermodynamic equilibrium. As such, during extended use at high temperature, Pt and Al in the coating material diffuse inward while the enhancing element diffuses out of the coating material. As a result, the article deteriorates.

Patent Document 1: U.S. Pat. No. 6,830,827

Patent Document 2: U.S. Patent Application 2004/0229075

DISCLOSURE OF INVENTION

Problems that the Invention is to Solve

It is an object of the present invention to provide a heat-resistant member that suppresses element interdiffusion at the substrate/coating interface even at elevated temperatures of 1,100° C. and higher.

Means for Solving the Problems

In order to achieve the foregoing object, the present invention provides:

Invention 1: A heat-resistant member including a Ni-base superalloy substrate coated with at least one coating substance, wherein the substrate and the coating substance are substantially in a state of thermodynamic equilibrium, or in a state similar to a state of thermodynamic equilibrium, at a predetermined temperature.

Invention 2: A heat-resistant member including a coating substance that includes at least one of γ phase, γ' phase, and B2 phase.

Invention 3: A heat-resistant member in which the coating substance inhibits formation of a diffusion modified layer at a surface of the substrate.

Invention 4: A heat-resistant member in which the diffusion modified layer is at least one of: generation of a single phase from the γ-γ' two-phase constitution of the Ni-base superalloy substrate; precipitation of a third phase; and a change in abundance of the γ' phase.

Invention 5: A heat-resistant member in which the article is made of such material that the modified layer at the coating interface has a thickness of 70 μm or less after heating and retaining at 1,100° C. for 300 hours.

Invention 6: A heat-resistant member in which the article is made of such material that the modified layer has a thickness of 50 μm or less.

Invention 7: A heat-resistant member in which the article is made of such material that the modified layer has a thickness of 40 μm or less.

Invention 8: A heat-resistant member according to any one of the heat-resistant members of Inventions 1 to 7, in which the coating substance is an alloy material that contains Ni and Al, or Ni, Al, and Cr, as essential components.

Invention 9: A heat-resistant member in which the article contains, in mass %, from 2.9% to 16.0% Al, and from 0% to 19.6% Cr, inclusive.

Invention 10: A heat-resistant member in which the article contains, in mass %, from 6.1% to 10.6% Al, and from 0.4% to 4.0% Cr, inclusive.

Invention 11: A heat-resistant member according to the heat-resistant member of Invention 1, in which the substrate and the substance have an aluminum chemical potential difference of 10% or less at 1,100° C.

ADVANTAGE OF THE INVENTION

With a heat-resistant member of the present invention, element interdiffusion at the substrate/coating interface is suppressed even at elevated temperatures of 1,100° C. and higher. This drastically improves durability during long use at high temperatures. For example, when a coating of the present invention is used as an oxidation-resistant bond coat on the ceramic top coat at the top surface of the substrate, substantially no unwanted diffusion layer is formed between the coating and the substrate. This is highly advantageous in terms of ease of substrate repair. Specifically, because the substrate is not damaged, it can be repaired multiple times, instead of only once as in conventional substrates.

BEST MODE FOR CARRYING OUT THE INVENTION

Figure 1:
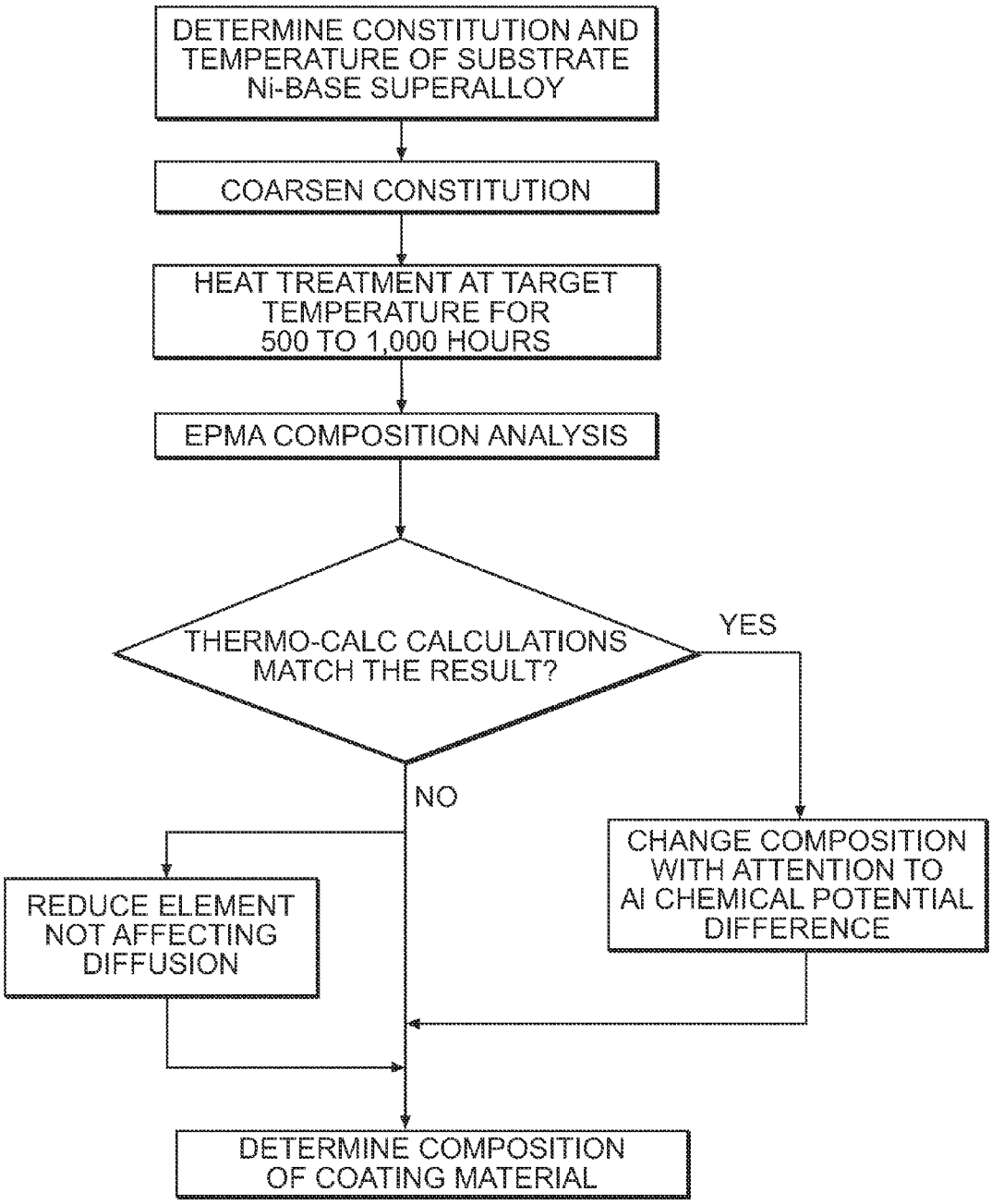
FIG. 1 is a flowchart representing a procedure of determining a coating material composition.

The following will describe a preferred embodiment of the present invention.

In the present invention, a coating layer, formed on the substrate Ni-base superalloy, is substantially in a state of thermodynamic equilibrium, or in a state similar to a state of thermodynamic equilibrium.

As used herein, "in a state of thermodynamic equilibrium" is defined as the state of theoretically equal chemical potential. In the context of the Ni-base superalloy and the alloy material (coating substance), the chemical potential $\mu_i$ of component i in the multi-alloy is represented by the following formula.

$$\mu_i = \mu_i^0 + RT\ln\frac{P_i}{P_i^0}$$

In the formula, $\mu_i^o$ is the free energy of component i in a normal state, $P_i^o$ is the vapor pressure of pure substance i, $P_i$ is the partial pressure of component i above the mixture, R the gas constant, and T the temperature. When two phases are in a state of thermodynamic equilibrium, the chemical potentials $\mu_i$ of these two phases are equal.

The element diffusion that occurs at the interface by the coating of the substrate is driven by a chemical potential difference. As such, diffusion of element i does not occur when the substrate and the element i in the coating material have the same chemical potential. It would therefore be desirable that the substrate and the coating material have the same chemical potential. However, the effect of the present invention can similarly be obtained even with compositions other than those described below, provided that the difference in chemical potential does not exceed a predetermined acceptable range.

In the present invention, the theoretical definition of a state of thermodynamic equilibrium given above can be technically substantiated by determining the composition of the coating material, taking into account the composition and constitution of the Ni-base superalloy.

Specifically, according to the present invention, a Ni-base superalloy, which is generally defined as a heat-resistant, high-strength alloy, and particularly an alloy capable of withstanding use at elevated temperatures of 950° C. and greater, is also characterized by its two-phase constitution including the γ phase and the γ' phase.

In a coating material for such a Ni-base superalloy, a state of thermodynamic equilibrium, inhibiting element diffusion, can be defined as being at least one of the following two conditions:

<1> The coating layer includes at least one of the γ phase, γ' phase, and B2 phase at a predetermined temperature; and <2> Formation of a diffusion modified layer is suppressed at the interface between the coating and the substrate, or more specifically, suppressing formation of the modified layer that results from the generation of a single phase from the γ-γ' two-phase constitution, precipitation of a third phase, or a change in abundance of the γ' phase.

In determining the composition of the coating material, the following procedure is considered to be practical.

Because the coating composition thermodynamically at equilibrium with the substrate varies with temperature, the temperature conditions of the environment in which the material is to be used are determined in advance.

The substrate Ni-base superalloy has the two phases, γ and γ'. As such, the two-phase constitution is first obtained in a size (about 1 μm or more) that can be analyzed by EPMA, using a method such as a recrystallization method. The superalloy is then heated and retained at the target temperature (for example, 1,100° C.) for 500 to 1,000 hours to obtain thermodynamic equilibrium. The composition of each coarse phase is then analyzed using EPMA. The analysis provides an equilibrium composition. In the case of a Ni-base superalloy to be equilibrated with the B2 phase, the compositions of the three phases γ, γ', and B2 are analyzed in a similar fashion.

Further, calculations may be performed using, for example, the integrated, thermodynamic calculation system Thermo-Calc (Thermo-Calc Software AB, Sweden) to find the equilibrium phase and the composition of the alloy, and the chemical potential of each element. When the result of analysis does not greatly differ from the calculated composition of each phase, the value of the chemical potential can be known as a reference.

For the coating composition, the composition of the γ, γ', or B2 phase obtained by the analysis is used. The selection of an element composition can be effectively made with attention to the Al (aluminum) contained in the substrate. The reason for this is as follows.

To begin with, the interdiffusion coefficients of the major elements in the Ni-base superalloy at, for example, 1,100° C. are reported as follows (M. S. A. Karunarante and R. C. Reed, Materials Science and Engineering, A281 (2000), 229-233; M. S. A. Karunarant and R. C. Reed, Acta Materials 51 (2003), 2905-2919; Substance/Material Database of the Applicant).

As high as $10^{14}$ $m^2/s$: Al, Hf, etc.

As high as $10^{15}$ $m^2/s$: Co, Cr, Ta, Mo, etc.

As high as $10^{16}$ $m^2/s$: W, Ru, Re, etc.

Al, being a fast-diffusing element and being required to increase oxidation-resistance, is an important, essential element for the coating material. Cr is the next important element, because it also affects oxidation-resistance. Hf is contained only in small concentration, and is therefore not an important element in the formation of the modified layer. Hf can therefore be reduced. Ta, Mo, W, Ru, and Re are relatively slow diffusing, and accordingly do not have a large effect on the formation of the modified layer caused by interdiffusion. It is therefore possible to reduce these elements. Since these elements are expensive, the price of the coating can be reduced by reducing these elements.

The inventors of the present invention have confirmed that the effect of the present invention can similarly be obtained even with element compositions that differ from the equilibrium composition, provided that the difference in chemical potential between the substrate Al and the coating Al is no more than 10% at 1,100° C.

The foregoing procedure is described below with reference to the flowchart of FIG. 1.

When using alloy coating materials, based on the foregoing description, the element composition of the coating material may be experimentally determined, and the effect of the composition may be evaluated using diffusion material samples prepared, for example, in the manner described in Examples 1 to 15 below.

The diffusion samples of Examples 1 to 15 may be deemed as the actual coating examples. In addition to heat diffusion using such diffusion materials, the coating method used in the present invention may employ a variety of spray methods. In this case, the composition can be determined based on assumption that the composition of the coating material after spraying is substantially the same as that of the raw material powder.

This can be done by appropriately referring to the values of chemical potential calculated by the integrated thermodynamic calculation system noted above.

For example, in Coating P of Example 38 below, the chemical potentials are given as follows.

Al: −181.93 kJ/mol (+10.99 kJ/mol, +5.7%)

Cr: −70.185 kJ/mol (+17.435 kJ/mol, 19.9%)

In contrast, Amdry 9954 of Conventional Technique 11 has the following chemical potential values.

Al: −165.11 kJ/mol (+27.81 kJ/mol, +14.4%)

Cr: −68.585 kJ/mol (+19.035 kJ/mol, +21.7%)

In a heat-resistant member of the present invention, the modified layer at the interface between the substrate and the coating material should preferably have a thickness of 70 μm or less, more preferably 56 μm or less, and further preferably 40 μm or less after being heated and retained at 1,100° C. for 360 hours.

In consideration of the above, the composition of the coating substance in a heat-resistance article of the present invention is preferably considered as follows.

<1> The coating substance is an alloy material that contains Ni and Al, or Ni, Al, and Cr, as essential components.

<2> The coating substance, defined above, contains, in mass %, 2.9% to 16.00% Al, and 0% to 19.60% Cr, inclusive.

<3> The coating substance, defined above, contains, in mass %, 6.1% to 10.60% Al, and 0.4% to 4.0% Cr, inclusive.

<4> The coating substance may be a Ni—Al binary alloy material of the composition that contains, in mass %, 7.8% to 16.00% Al, or may be a Ni—Al—Cr ternary alloy material of the composition that contains, in mass %, 7.8% to 16.0% Al, and 5.00% to 19.6% Cr.

<5> The coating substance may be a ceramic material.

Concerning the substrate Ni-base superalloy and the alloy coating material, the following (1) to (12) represents non-limiting, preferable composition examples of the substrate Ni-base superalloy.

(1) Al: at least 1.0 mass % to at most 10.0 mass %, Ta: at least 0 mass % to at most 14.0 mass %, Mo: at least 0 mass % to at most 10.0 mass %, W: at least 0 mass % to at most 15.0 mass %, Re: at least 0 mass % to at most 10.0 mass %, Hf: at least 0 mass % to at most 3.0 mass %, Cr: at least 0 mass % to at most 20.0 mass %, Co: at least 0 mass % to at most 20 mass %, Ru: at least 0 mass % to at most 14.0 mass %, Nb: at least 0 mass % to at most 4.0 mass %, Si: at least 0 mass % to at most 2.0 mass %.

(2) Al: at least 3.5 mass % to at most 7.0 mass %, Ta: at least 2.0 mass % to at most 12.0 mass %, Mo: at least 0 mass % to at most 4.5 mass %, W: at least 0 mass % to at most 10.0 mass %, Re: at least 0 mass % to at most 8.0 mass %, Hf: at least 0 mass % to at most 0.50 mass %, Cr: at least 1.0 mass % to at most 15.0 mass %, Co: at least 2 mass % to at most 16 mass %, Ru: at least 0 mass % to at most 14.0 mass %, Nb: at least 0 mass % to at most 2.0 mass %, Si: at least 0 mass % to at most 2.0 mass %, and the remainder Ni and incidental impurities.

(3) Al: at least 5.0 mass % to at most 7.0 mass %, Ta: at least 4.0 mass % to at most 10.0 mass %, Mo: at least 1.1 mass % to at most 4.5 mass %, W: at least 4.0 mass % to at most 10.0 mass %, Re: at least 3.1 mass % to at most 8.0 mass %, Hf: at least 0 mass % to at most 0.50 mass %, Cr: at least 2.0 mass % to at most 10.0 mass %, Co: at least 0 mass % to at most 15.0 mass %, Ru: at least 4.1 mass % to at most 14.0 mass %, Nb: at least 0 mass % to at most 2.0 mass %, Si: at least 0 mass % to at most 2.0 mass %, and the remainder Ni and incidental impurities.

(4) Al: at least 5.0 mass % to at most 7.0 mass %, Ta: at least 4.0 mass % to at most 8.0 mass %, Mo: at least 1.0 mass % to at most 4.5 mass %, W: at least 4.0 mass % to at most 8.0 mass %, Re: at least 3.0 mass % to at most 6.0 mass %, Hf: at least 0.01 mass % to at most 0.50 mass %, Cr: at least 2.0 mass % to at most 10.0 mass %, Co: at least 0.1 mass % to at most 15.0 mass %, Ru: at least 1.0 mass % to at most 4.0 mass %, Nb: at least 0 mass % to at most 2.0 mass %, and the remainder Ni and incidental impurities.

(5) Al: at least 5.5 mass % to at most 6.5 mass %, Ta: at least 5.0 mass % to at most 7.0 mass %, Mo: at least 1.0 mass % to at most 4.0 mass %, W: at least 4.0 mass % to at most 7.0 mass %, Re: at least 4.0 mass % to at most 5.5 mass %, Ti: at least 0 mass % to at most 2.0 mass %, Nb: at least 0 mass % to at most 2.0 mass %, Hf: at least 0 mass % to at most 0.50 mass %, V: at least 0 mass % to at most 0.50 mass %, Cr: at least 0.1 mass % to at most 4.0 mass %, Co: at least 7.0 mass % to at most 15.0 mass %, Si: at least 0.01 mass % to at most 0.1 mass %, and the remainder Ni and incidental impurities.

(6) Al: at least 4.5 mass % to at most 6.0 mass %, Ta: at least 5.0 mass % to at most 8.0 mass %, Mo: at least 0.5 mass % to at most 3.0 mass %, W: at least 7.0 mass % to at most 10.0 mass %, Re: at least 1.0 mass % to at most 3.0 mass %, Ti: at least 0.1 mass % to at most 2.0 mass %, Hf: at least 0.01 mass % to at most 0.50 mass %, Cr: at least 3.5 mass % to at most 5.0 mass %, Co: at least 4.0 mass % to at most 11.0 mass %, Si: at least 0.01 mass % to at most 0.1 mass %, and the remainder Ni and incidental impurities.

(7) Al: at least 5.1 mass % to at most 6.1 mass %, Ta: at least 4.5 mass % to at most 6.1 mass %, Mo: at least 2.1 mass % to at most 3.3 mass %, W: at least 4.1 mass % to at most 7.1 mass %, Re: at least 6.4 mass % to at most 7.4 mass %, Ti: at least 0 mass % to at most 0.5 mass %, Hf: at least 0 mass % to at most 0.50 mass %, Cr: at least 2.5 mass % to at most 7.0 mass %, Co: at least 5.1 mass % to at most 6.1 mass %, Ru: at least 4.5 mass % to at most 5.5 mass %, Nb: at least 0 mass % to at most 1.0 mass %, and the remainder Ni and incidental impurities.

(8) Al: at least 5.3 mass % to at most 6.3 mass %, Ta: at least 5.3 mass % to at most 6.3 mass %, Mo: at least 2.4 mass % to at most 4.4 mass %, W: at least 4.3 mass % to at most 6.3 mass %, Re: at least 4.4 mass % to at most 5.4 mass %, Ti: at least 0 mass % to at most 0.5 mass %, Hf: at least 0 mass % to at most 0.50 mass %, Cr: at least 2.5 mass % to at most 7.0 mass %, Co: at least 5.3 mass % to at most 6.3 mass %, Ru: at least 5.5 mass % to at most 6.5 mass %, Nb: at least 0 mass % to at most 1.0 mass %, and the remainder Ni and incidental impurities.

(9) Al: at least 5.2 mass % to at most 6.2 mass %, Ta: at least 5.1 mass % to at most 6.1 mass %, Mo: at least 2.1 mass % to at most 3.3 mass %, W: at least 4.1 mass % to at most 6.1 mass %, Re: at least 5.3 mass % to at most 6.3 mass %, Ti: at least 0 mass % to at most 0.5 mass %, Hf: at least 0 mass % to at most 0.50 mass %, Cr: at least 2.7 mass % to at most 7.0 mass %, Co: at least 5.3 mass % to at most 6.3 mass %, Ru: at least 3.1 mass % to at most 4.1 mass %, Nb: at least 0 mass % to at most 1.0 mass %, and the remainder Ni and incidental impurities.

(10) Al: at least 5.4 mass % to at most 6.4 mass %, Ta: at least 5.1 mass % to at most 6.1 mass %, Mo: at least 2.1 mass % to at most 3.3 mass %, W: at least 4.4 mass % to at most 6.4 mass %, Re: at least 4.5 mass % to at most 5.5 mass %, Ti: at least 0 mass % to at most 0.5 mass %, Hf: at least 0 mass % to at most 0.50 mass %, Cr: at least 2.7 mass % to at most 7.0 mass %, Co: at least 5.3 mass % to at most 6.3 mass %, Ru: at least 4.5 mass % to at most 5.5 mass %, Nb: at least 0 mass % to at most 1.0 mass %, and the remainder Ni and incidental impurities.

(11) Al: at least 5.5 mass % to at most 6.5 mass %, Ta: at least 5.5 mass % to at most 6.5 mass %, Mo: at least 1.5 mass % to at most 2.5 mass %, W: at least 5.5 mass % to at most 6.5 mass %, Re: at least 4.5 mass % to at most 5.5 mass %, Ti: at least 0 mass % to at most 0.5 mass %, Hf: at least 0 mass % to at most 0.50 mass %, Cr: at least 2.5 mass % to at most 3.5 mass %, Co: at least 11.5 mass % to at most 12.5 mass %, Nb: at least 0 mass % to at most 1.0 mass %, and the remainder Ni and incidental impurities.

(12) Al: at least 4.8 mass % to at most 5.8 mass %, Ta: at least 5.5 mass % to at most 6.5 mass %, Mo: at least 1.4 mass % to at most 2.4 mass %, W: at least 8.2 mass % to at most 9.2 mass %, Re: at least 1.6 mass % to at most 2.6 mass %, Ti: at least 0 mass % to at most 2.0 mass %, Nb: at least 0 mass % to at most 2.0 mass %, Hf: at least 0 mass % to at most 0.50 mass %, Cr: at least 4.4 mass % to at most 5.4 mass %, Co: at least 7.3 mass % to at most 8.3 mass %, and the remainder Ni and incidental impurities.

In these examples of the Ni-base superalloy, the compositions (1) to (6) are inclusive of the compositions (7) to (12).

Taking the Ni-base superalloys (7) to (12) as an example, the following represents preferable alloys (coating materials, (13) to (20)) to be coated on the substrate formed of these superalloys. It should be noted that the present invention is not limited to the following.

(13) The composition of the alloy coated on the Ni-base superalloy (7) contains Al: at least 6.8 mass % to at most 8.8 mass %, Ta: at least 7.0 mass % to at most 9.0 mass %, Mo: at least 0.5 mass % to at most 2.0 mass %, W: at least 3.3 mass % to at most 6.3 mass %, Re: at least 1.6 mass % to at most 3.6 mass %, Ti: at least 0 mass % to at most 1.5 mass %, Hf: at least 0 mass % to at most 1.15 mass %, Cr: at least 0.5 mass % to at most 6.0 mass %, Co: at least 3.2 mass % to at most 5.2 mass %, Ru: at least 2.9 mass % to at most 4.9 mass %, Nb: at least 0 mass % to at most 1.5 mass %, and the remainder Ni and incidental impurities.

(14) The composition of the alloy coated on the Ni-base superalloy (8) contains Al: at least 6.1 mass % to at most 8.1 mass %, Ta: at least 4.8 mass % to at most 6.8 mass %, Mo: at least 1.9 mass % to at most 3.9 mass %, W: at least 3.8 mass % to at most 6.8 mass %, Re: at least 1.4 mass % to at most 3.4 mass %, Ti: at least 0 mass % to at most 1.5 mass %, Hf: at least 0 mass % to at most 1.15 mass %, Cr: at least 1.3 mass % to at most 6.0 mass %, Co: at least 4.0 mass % to at most 6.0 mass %, Ru: at least 4.2 mass % to at most 6.2 mass %, Nb: at least 0 mass % to at most 1.5 mass %, and the remainder Ni and incidental impurities.

(15) The composition of the alloy coated on the Ni-base superalloy (9) contains Al: at least 7.1 mass % to at most 9.1 mass %, Ta: at least 7.2 mass % to at most 9.2 mass %, Mo: at least 0.5 mass % to at most 2.5 mass %, W: at least 3.3 mass % to at most 6.3 mass %, Re: at least 1.1 mass % to at most 3.1 mass %, Ti: at least 0 mass % to at most 1.5 mass %, Hf: at least 0 mass % to at most 1.15 mass %, Cr: at least 0.6 mass % to at most 6.0 mass %, Co: at least 3.3 mass % to at most 5.3 mass %, Ru: at least 1.8 mass % to at most 3.8 mass %, Nb: at least 0 mass % to at most 1.5 mass %, and the remainder Ni and incidental impurities.

(16) The composition of the alloy coated on the Ni-base superalloy (10) contains Al: at least 7.3 mass % to at most 9.3 mass %, Ta: at least 7.2 mass % to at most 9.2 mass %, Mo: at least 0.5 mass % to at most 2.5 mass %, W: at least 3.5 mass % to at most 6.5 mass %, Re: at least 0.8 mass % to at most 1.3 mass %, Ti: at least 0 mass % to at most 1.5 mass %, Hf: at least 0 mass % to at most 1.15 mass %, Cr: at least 0.6 mass % to at most 6.0 mass %, Co: at least 3.3 mass % to at most 5.3 mass %, Ru: at least 0.5 mass % to at most 2.5 mass %, Nb: at least 0 mass % to at most 1.5 mass %, and the remainder Ni and incidental impurities.

(17) The composition of the alloy coated on the Ni-base superalloy (11) contains Al: at least 7.5 mass % to at most 9.5 mass %, Ta: at least 8.3 mass % to at most 10.3 mass %, Mo: at least 0 mass % to at most 2.0 mass %, W: at least 4.8 mass % to at most 6.8 mass %, Re: at least 0.6 mass % to at most 1.8 mass %, Ti: at least 0 mass % to at most 1.5 mass %, Hf: at least 0 mass % to at most 1.15 mass %, Cr: at least 0.4 mass % to at most 2.4 mass %, Co: at least 8.2 mass % to at most 10.2 mass %, Nb: at least 0 mass % to at most 1.5 mass %, and the remainder Ni and incidental impurities.

(18) The composition of the alloy coated on the Ni-base superalloy (12) contains Al: at least 6.9 mass % to at most 8.9 mass %, Ta: at least 8.5 mass % to at most 10.5 mass %, Mo: at least 0 mass % to at most 1.9 mass %, W: at least 6.2 mass % to at most 8.2 mass %, Re: at least 0 mass % to at most 1.5 mass %, Ti: at least 0 mass % to at most 1.7 mass %, Hf: at least 0 mass % to at most 1.15 mass %, Cr: at least 0.4 mass % to at most 2.4 mass %, Co: at least 3.7 mass % to at most 5.7 mass %, Nb: at least 0 mass % to at most 1.5 mass %, and the remainder Ni and incidental impurities.

(19) In the compositions (13) to (18), the composition of the coating alloy is inclusive of 0 mass % to 1.0 mass % of at least one element selected from Si, Y, La, Ce, and Zr.

(20) In the compositions (13) to (19), the composition of the coating alloy is exclusive of at least one element selected from Ru, Ta, Mo, W, and Re.

In consideration of the foregoing examples, the coating alloy (coating material) of the present invention is preferably considered to be of the composition that contains Al: at least 6.1 mass % to at most 10.6 mass %, Ta: at least 0 mass % to at most 10.5 mass %, Mo: at least 0 mass % to at most 3.9 mass %, W: at least 0 mass % to at most 8.2 mass %, Re: at least 0 mass % to at most 3.4 mass %, Ti: at least 0 mass % to at most 1.7 mass %, Hf: at least 0 mass % to at most 1.15 mass %, Cr: at least 0.4 mass % to at most 4.0 mass %, Co: at least 3.2 mass % to at most 10.2 mass %, Ru: at least 0 mass % to at most 6.2 mass %, Nb: at least 0 mass % to at most 1.5 mass %, Si: at least 0 mass % to at most 1.0 mass %, Y: at least 0 mass % to at most 1.0 mass %, La: at least 0 mass % to at most 1.0 mass %, Ce: at least 0 mass % to at most 1.0 mass %, Zr: at least 0 mass % to at most 1.0 mass %, and the remainder Ni and incidental impurities.

EXAMPLES

Examples 1 to 15

The substrate was prepared by casting a single crystal alloy rod (ø 10×130 mm) using a directional solidification technique in a vacuum. After a solution heat treatment, the rod was cut into a test piece measuring 10 mm in diameter and 5 mm in thickness. This was used as a substrate sample of each different alloy composition shown in Table 1. For the coating material, a coating material of each different composition shown in Table 2 was prepared using arc-melting in an Ar atmosphere. The material was homogenized at 1,250° C. for 10 hours, and cut into a test piece measuring 10 mm in diameter and 5 mm in thickness. The coating material samples and the substrate samples so prepared were surface-polished, and were mated to prepare substrate/coating material diffusion couples. The couples were subjected to a diffusion heat treatment at 1,100° C. for 300 hours in an atmosphere to examine diffusion behavior. After the test, a cross section of each diffusion couple was observed with a scanning electron microscope (SEM) to measure a thickness of the modified layer. Table 3 shows the results of thickness measurement of the modified layer. The samples were also analyzed with regard to the diffusion state of the elements, using an electron probe microanalyzer (EPMA). Table 4 shows the result of evaluation of the equilibrium state of each coating material.

The samples were also tested in repeated cycles of one hour at 1,100° C. in an atmosphere.

TABLE 1

| | Chemical composition (wt %) | | | | | | | | | | |
|---|---|---|---|---|---|---|---|---|---|---|---|
| | Ni | Co | Cr | Mo | W | Al | Ti | Ta | Hf | Re | Ru |
| TMS-82+ | Bal. | 7.8 | 4.9 | 1.9 | 8.7 | 5.3 | 0.5 | 6.0 | 0.10 | 2.1 | — |
| TMS-75 | Bal. | 12.0 | 3.0 | 2.0 | 6.0 | 6.0 | — | 6.0 | 0.10 | 5.0 | — |
| TMS-138 | Bal. | 5.8 | 3.2 | 2.8 | 5.9 | 5.9 | — | 5.6 | 0.10 | 5.0 | 2.0 |
| TMS-138A | Bal. | 5.8 | 3.2 | 2.8 | 5.6 | 5.7 | — | 5.6 | 0.10 | 5.8 | 3.6 |
| TMS-162 | Bal. | 5.8 | 2.9 | 3.9 | 5.8 | 5.8 | — | 5.8 | 0.10 | 4.9 | 6.0 |
| TMS-173 | Bal. | 5.6 | 2.8 | 2.8 | 5.6 | 5.6 | — | 5.6 | 0.10 | 6.9 | 5 |
| Ni—14Cr—9.6Al | Bal. | — | 14.0 | — | — | 9.6 | — | — | — | — | — |

TABLE 2

| | Chemical composition (wt %) | | | | | | | | | | |
|---|---|---|---|---|---|---|---|---|---|---|---|
| | Ni | Co | Cr | Mo | W | Al | Ti | Ta | Hf | Re | Ru |
| Coating 1 | Bal | 10.5 | 7.6 | 2.6 | 10.0 | 2.9 | 0.2 | 3.4 | 0.03 | 4.2 | — |
| Coating 2 | Bal. | 4.7 | 1.4 | 0.9 | 7.2 | 7.9 | 0.7 | 9.5 | 0.16 | 0.5 | — |
| Coating 3 | Bal. | 9.2 | 1.4 | 1.0 | 5.8 | 8.5 | — | 6.0 | 0.10 | 5.0 | — |
| Coating 4 | Bal. | 4.3 | 1.6 | 1.5 | 5.5 | 8.3 | — | 8.2 | 0.15 | 1.8 | 1.5 |
| Coating 5 | Bal. | 4.3 | 1.6 | 1.5 | 5.3 | 8.1 | — | 8.2 | 0.18 | 2.1 | 2.8 |
| Coating 6 | Bal. | 5.0 | 2.3 | 2.6 | 5.8 | 7.1 | — | 7.1 | 0.12 | 2.4 | 5.2 |
| Coating 7 | Bal. | 4.2 | 1.5 | 1.5 | 5.3 | 7.8 | — | 8.0 | 0.15 | 2.6 | 3.9 |
| Coating 8 | Bal. | — | 5.0 | — | — | 10.0 | — | — | — | — | — |
| Coating 9 | Bal. | — | 5.0 | — | — | 10.0 | — | 3.0 | — | — | — |
| Coating 10 | Bal. | — | | — | — | 12.7 | — | — | — | — | — |
| Coating 11 | Bal. | — | 8.5 | — | — | 16.0 | — | — | — | — | — |
| Coating 12 | Bal. | — | 8.4 | — | — | 11.4 | — | — | — | — | — |
| Coating 13 | Bal. | — | 19.6 | — | — | 7.8 | — | — | — | — | — |
| Coating 14 | Bal. | — | 8.4 | — | — | 13.7 | — | — | — | — | — |
| Coating 15 | Bal. | — | 12.1 | — | — | 11.7 | — | — | — | — | — |
| MCrAlY | Bal. | — | 22.0 | — | — | 10.0 | — | — | — | — | — |
| CoNiCrAlY | Bal. | 38.5 | 21.0 | — | — | 8.0 | — | — | — | — | — |
| Ni—Al | Bal. | — | — | — | — | 32.0 | — | — | — | — | — |

TABLE 3

| | Coating | Substrate | Thickness of modified layer |
|---|---|---|---|
| Example 1 | Coating 1 | TMS-82+ | 1 μm or less |
| Example 2 | Coating 2 | TMS-82+ | 1 μm or less |
| Example 3 | Coating 3 | TMS-75 | 1 μm or less |
| Example 4 | Coating 4 | TMS-138 | 1 μm or less |
| Example 5 | Coating 5 | TMS-138A | 1 μm or less |
| Example 6 | Coating 6 | TMS-162 | 1 μm or less |
| Example 7 | Coating 7 | TMS-173 | 1 μm or less |
| Example 8 | Coating 8 | TMS-173 | 10 μm |
| Example 9 | Coating 9 | TMS-173 | 5 μm |
| Example 10 | Coating 10 | TMS-173 | 14 μm |
| Example 11 | Coating 11 | Ni—14Cr—9.6Al | 1 μm or less |
| Example 12 | Coating 12 | Ni—14Cr—9.6Al | 1 μm or less |
| Example 13 | Coating 13 | Ni—14Cr—9.6Al | 1 μm or less |
| Example 14 | Coating 14 | Ni—14Cr—9.6Al | 1 μm or less |
| Example 15 | Coating 15 | Ni—14Cr—9.6Al | 1 μm or less |
| Conventional Technique 1 | MCrAlY | TMS-173 | 123 μm |
| Conventional Technique 2 | CoNiCrAlY | TMS-173 | 173 μm |
| Conventional Technique 3 | CoNiCrAlY | TMS-138 | 160 μm |
| Conventional Technique 4 | Ni—Al | TMS-138 | 129 μm |

TABLE 4

| | |
|---|---|
| Coating 1 | γ in equilibrium with TMS-82+ |
| Coating 2 | γ' in equilibrium with TMS-82+ |
| Coating 3 | γ' in equilibrium with TMS-75 |
| Coating 4 | γ' in equilibrium with TMS-138 |
| Coating 5 | γ' in equilibrium with TMS-138A |

TABLE 4-continued

| | |
|---|---|
| Coating 6 | γ' in equilibrium with TMS-162 |
| Coating 7 | γ' in equilibrium with TMS-173 |
| Coating 8 | γ' in equilibrium with TMS-173 and Al |
| Coating 9 | γ' in equilibrium with TMS-173 and Al |
| Coating 10 | γ' in equilibrium with TMS-173 and Al |
| Coating 11 | β + γ in equilibrium with Ni—14Cr—9.6Al |
| Coating 12 | γ' in equilibrium with Ni—14Cr—9.6Al |
| Coating 13 | γ in equilibrium with Ni—14Cr—9.6Al |
| Coating 14 | β + γ' in equilibrium with Ni—14Cr—9.6Al |
| Coating 15 | γ + γ' + β in equilibrium with Ni—14Cr—9.6Al |
| MCrAlY | Conventional coating (β + γ) |
| CoNiCrAlY | Conventional coating (β + γ) |
| Ni—Al | Conventional coating (β) |

As is clear from Table 3, the thickness of the modified layer is considerably thinner in the Examples than in the Conventional Techniques. Specifically, the thickness of the modified layer was almost unobservable (1 μm or less) in the coatings of Examples 1 to 7 and Examples 11 to 15, in which all the elements are in a state of thermodynamic equilibrium. A considerable reduction of the modified layer from the Conventional Techniques was also observed in Examples 8 to 10, in which the expensive elements, such as Ru, Ta, Mo, W, and Re, are excluded from the coating, and Al, which diffuses at the fastest rate and causes the formation of the modified layer, is in a state of thermodynamic equilibrium with the substrate Ni-base superalloy.

Tables 5 and 6 show examples of some of the chemical potentials of the alloy substrates and the coating materials of Tables 1 and 2, as calculated by Thermo-calc calculations.

The evaluation of equilibrium does not necessarily conform to the experiment results (Table 4). This is considered to be due to the limitations and errors in the calculations.

TABLE 5

| | Ni | Co | Cr | Mo | W | Al |
|---|---|---|---|---|---|---|
| TMS-82+ | −8.16E+04 | −9.61E+04 | −7.86E+04 | −9.42E+04 | −8.25E+04 | −1.92E+05 |
| TMS-75 | −8.18E+04 | −9.05E+04 | −8.58E+04 | −9.61E+04 | −9.12E+04 | −1.90E+05 |
| TMS-138 | −8.03E+04 | −9.84E+04 | −8.51E+04 | −9.24E+04 | −9.05E+04 | −1.93E+05 |
| TMS-138A | −8.04E+04 | −9.85E+04 | −8.57E+04 | −9.31E+04 | −9.14E+04 | −1.93E+05 |
| TMS-162 | −8.12E+04 | −9.83E+04 | −8.62E+04 | −8.82E+04 | −9.09E+04 | −1.91E+05 |
| TMS-173 | −8.04E+04 | −9.86E+04 | −8.76E+04 | −9.40E+04 | −9.21E+04 | −1.93E+05 |
| TMS-196 | −8.12E+04 | −9.94E+04 | −8.16E+04 | −9.55E+04 | −9.18E+04 | −1.91E+05 |
| Ni—14Cr—9.6Al | −8.45E+04 | — | −6.56E+04 | — | — | −1.76E+05 |
| René N5 | −8.36E+04 | −9.67E+04 | −7.34E+04 | −9.18E+04 | −8.53E+04 | −1.85E+05 |

| | Ti | Ta | Hf | Re | Ru |
|---|---|---|---|---|---|
| TMS-82+ | −2.03E+05 | −1.88E+05 | −2.50E+05 | −1.05E+05 | — |
| TMS-75 | — | −1.92E+05 | −2.54E+05 | −9.52E+04 | — |
| TMS-138 | — | −1.97E+05 | −2.56E+05 | −9.64E+04 | −9.69E+04 |
| TMS-138A | — | −1.96E+05 | −2.55E+05 | −9.58E+04 | −9.06E+04 |
| TMS-162 | — | −1.95E+05 | −2.54E+05 | −9.90E+04 | −8.48E+04 |
| TMS-173 | — | −1.97E+05 | −2.56E+05 | −9.50E+04 | −8.66E+04 |
| TMS-196 | — | −1.94E+05 | −2.53E+05 | −9.58E+04 | −8.79E+04 |
| Ni—14Cr—9.6Al | — | — | — | — | — |
| René N5 | — | −1.82E+05 | −2.38E+05 | −9.70E+04 | — |

Unit: J/mol

TABLE 6

| | Ni | Co | Cr | Mo | W |
|---|---|---|---|---|---|
| Coating 1 | −8.09E+04 | −9.50E+04 | −7.95E+04 | −9.60E+04 | −8.54E+04 |
| Coating 2 | −8.31E+04 | −9.86E+04 | −7.83E+04 | −9.12E+04 | −7.83E+04 |
| Coating 3 | −8.24E+04 | −9.00E+04 | −8.69E+04 | −1.05E+05 | −9.42E+04 |
| Coaling 4 | −8.16E+04 | −9.86E+04 | −8.05E+04 | −9.30E+04 | −8.83E+04 |
| Coating 5 | −8.14E+04 | −9.84E+04 | −8.17E+04 | −9.38E+04 | −8.89E+04 |
| Coating 6 | −8.16E+04 | −9.87E+04 | −8.34E+04 | −8.89E+04 | −8.78E+04 |
| Coating 7 | −8.10E+04 | −9.88E+04 | −8.47E+04 | −9.51E+04 | −8.97E+04 |
| Coating 8 | −7.78E+04 | — | −8.19E+04 | — | — |

TABLE 6-continued

| | | | | | |
|---|---|---|---|---|---|
| Coating 9 | −7.90E+04 | — | −7.58E+04 | — | — |
| Coating 10 | −7.73E+04 | — | — | — | — |
| Coating 11 | −8.46E+04 | — | −6.55E+04 | — | — |
| Coating 12 | −8.45E+04 | — | −6.56E+04 | — | — |
| Coating 13 | −8.45E+04 | — | −6.55E+04 | — | — |
| Coating 14 | −8.46E+04 | — | −6.56E+04 | — | — |
| Coating 15 | −8.46E+04 | — | −6.55E+04 | — | — |
| MCrAlY | −8.70E+04 | — | −6.15E+04 | — | — |
| CoNiCrAlY | −9.49E+04 | −8.48E+04 | −6.86E+04 | — | — |
| Ni—Al | −1.32E+05 | — | — | — | — |
| | Al | Ti | Ta | Re | Ru |
| Coating 1 | −1.97E+05 | −2.10E+05 | −1.86E+05 | −1.01E+05 | — |
| Coating 2 | −1.86E+05 | −2.00E+05 | −1.85E+05 | −1.09E+05 | — |
| Coating 3 | −1.86E+05 | — | −2.02E+05 | −9.06E+04 | — |
| Coaling 4 | −1.89E+05 | — | −1.96E+05 | −9.83E+04 | −9.69E+04 |
| Coating 5 | −1.90E+05 | — | −1.97E+05 | −9.77E+04 | −8.99E+04 |
| Coating 6 | −1.90E+05 | — | −1.96E+05 | −1.01E+05 | −8.49E+04 |
| Coating 7 | −1.91E+05 | — | −1.98E+05 | −9.62E+04 | −8.63E+04 |
| Coating 8 | −1.94E+05 | — | — | — | — |
| Coating 9 | −1.92E+05 | — | −2.21E+05 | — | — |
| Coating 10 | −1.93E+05 | — | — | — | — |
| Coating 11 | −1.75E+05 | — | — | — | — |
| Coating 12 | −1.76E+05 | — | — | — | — |
| Coating 13 | −1.76E+05 | — | — | — | — |
| Coating 14 | −1.75E+05 | — | — | — | — |
| Coating 15 | −1.75E+05 | — | — | — | — |
| MCrAlY | −1.72E+05 | — | — | — | — |
| CoNiCrAlY | −1.65E+05 | — | — | — | — |
| Ni—Al | −1.17E+05 | — | — | — | — |

Unit: J/mol

Figure 2:
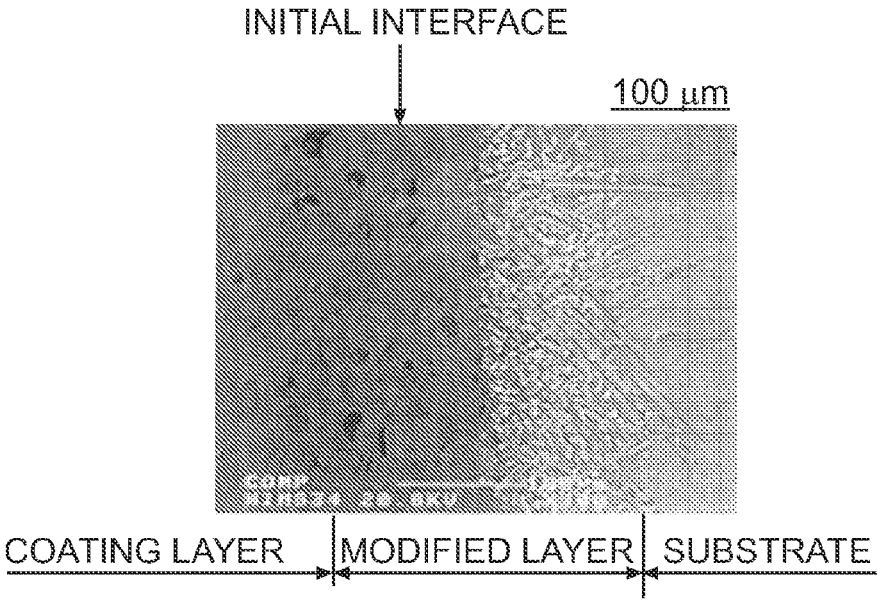
FIG. 2 depicts micrographs of the coating/substrate interfaces of the samples obtained in Example 1 and Conventional Technique 1, taken after a heating and retaining test performed at 1,100° C. for 300 hours.
Figure 2:
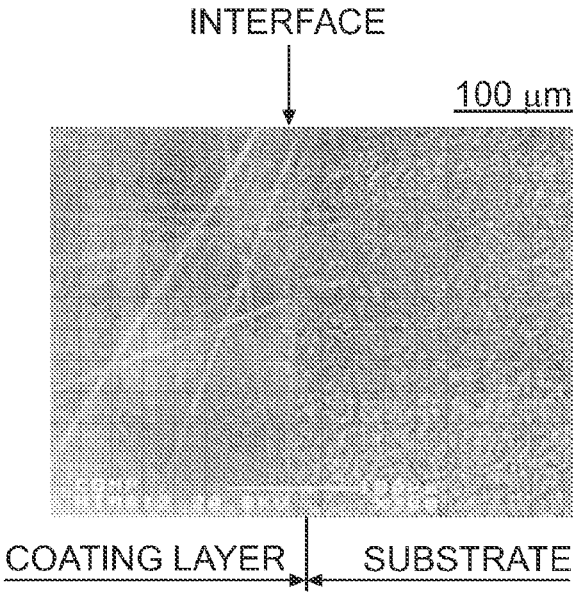
Figure 3:
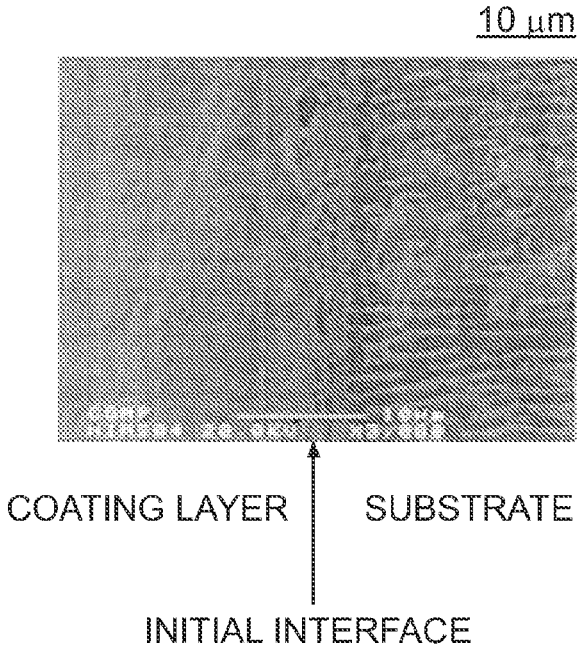
FIG. 3 depicts an enlargement of the micrograph of the sample of Example 1.

FIG. 2 depicts micrographs of the coating/substrate interfaces of the samples obtained in Conventional Technique 1 and Example 1, taken after a heating and retaining test performed at 1,100° C. for 300 hours. FIG. 3 depicts an enlargement of the photograph of the sample of Example 1. In contrast to Conventional Technique 1 in which a modified layer of 123 μm thick was observed, no modified layer was formed in Example 1.

Figure 4A:
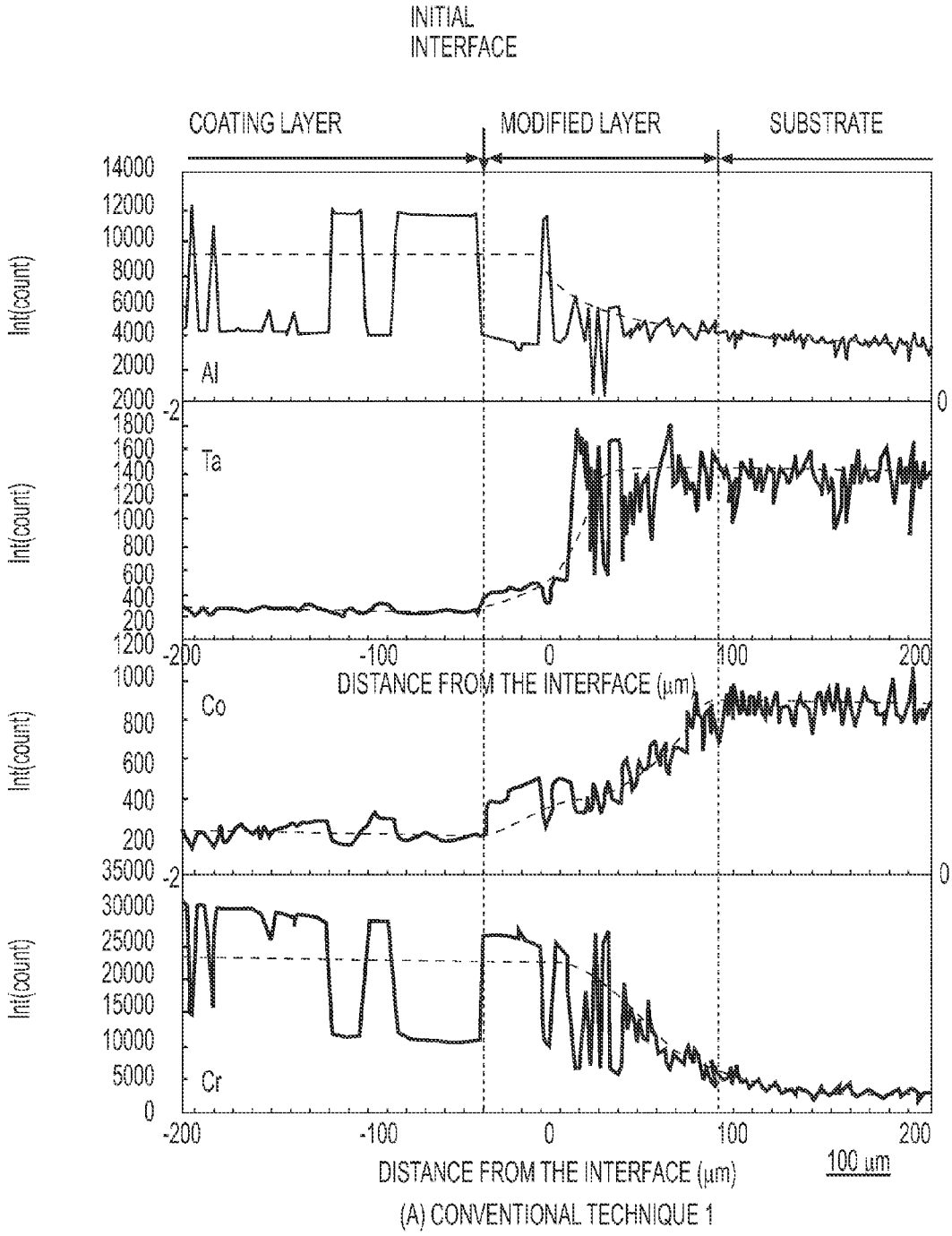
FIG. 4 depicts graphs representing the results of EPMA element analysis of the coating/substrate interfaces of the samples obtained in Example 1 and Conventional Technique 1, conducted after a heating and retaining test performed at 1,100° C. for 300 hours.
Figure 4B:
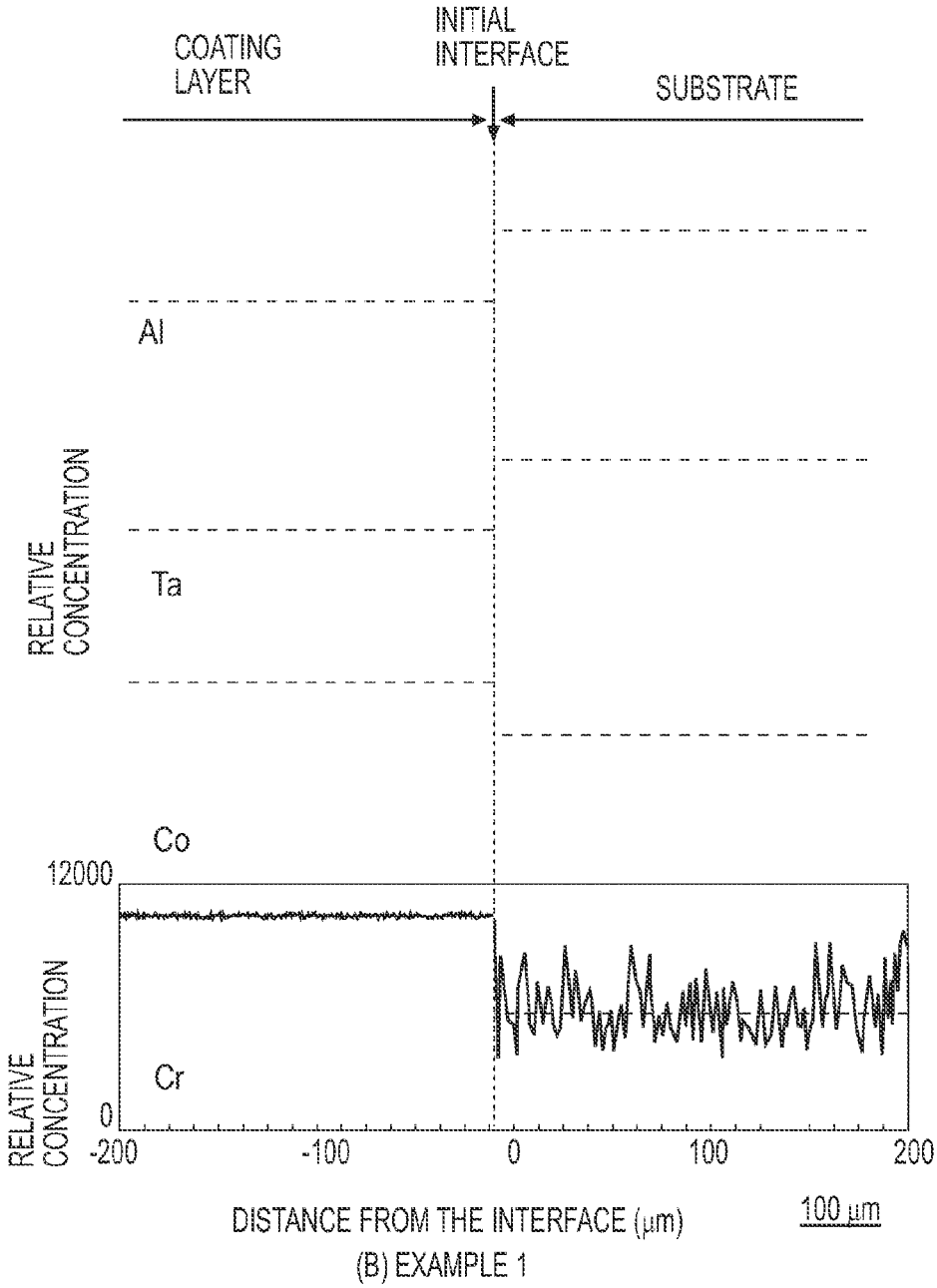

FIG. 4 depicts the results of EPMA element analysis of the coating/substrate interfaces of the samples obtained in Conventional Technique 1 and Example 1, conducted after a heating and retaining test performed at 1,100° C. for 300 hours. It can be seen from the results of element analysis that while a modified layer was formed in Conventional Technique 1 by the diffusion that occurred at the coating/substrate interface over a 123 μm range, no element diffusion occurred in Example 1.

Figure 5:
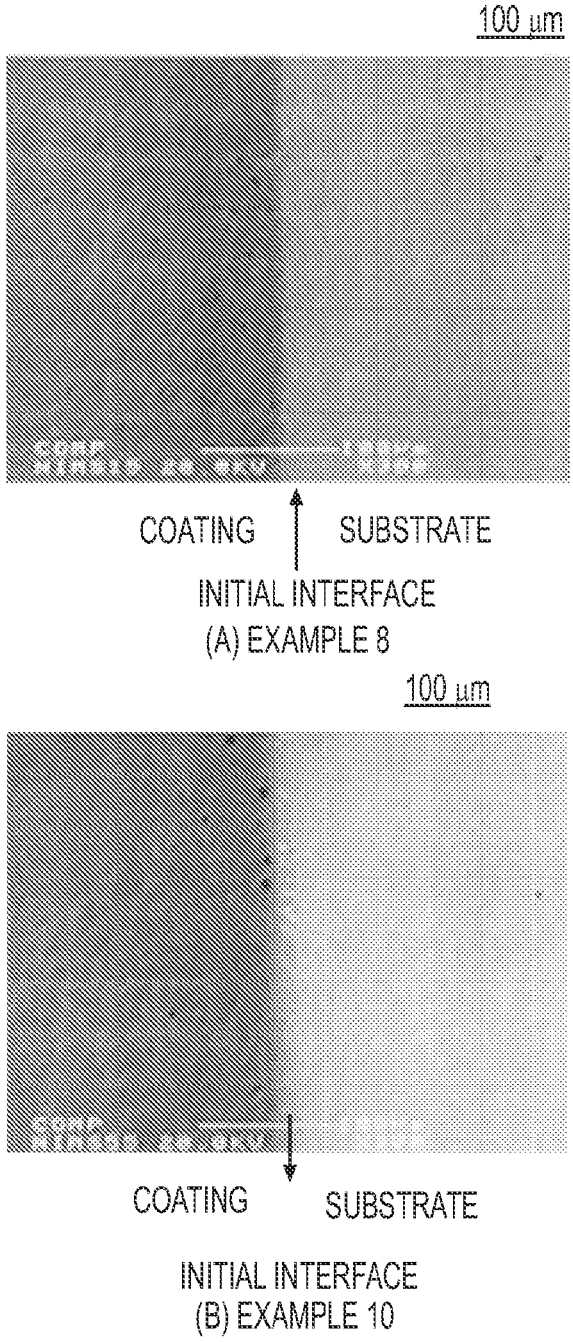
FIG. 5 depicts micrographs of the coating/substrate interfaces of the samples obtained in Examples 8 and 10, taken after a heating and retaining test performed at 1,100° C. for 300 hours.
Figure 6:
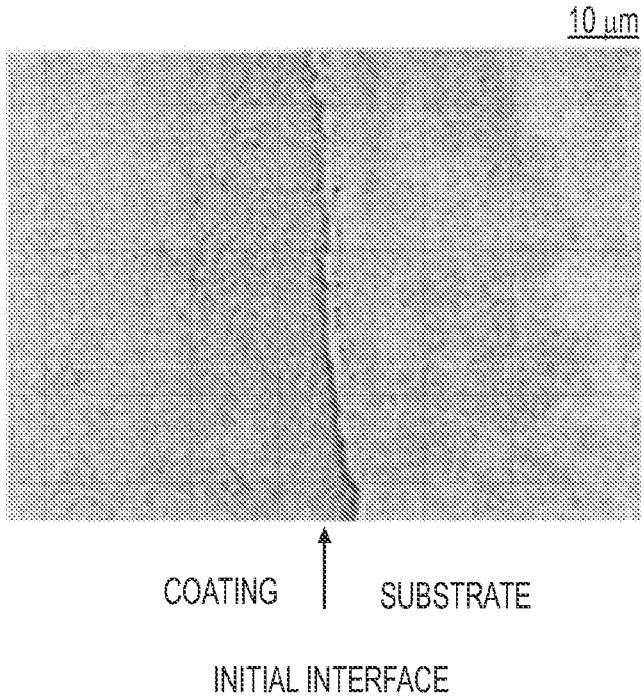
FIG. 6 depicts a micrograph of the coating/substrate interface of the sample obtained in Example 11, taken after a heating and retaining test performed at 1,100° C. for 300 hours.

FIG. 5 depicts micrographs of the coating/substrate interfaces of the samples obtained in Examples 8 and 10, taken after a heating and retaining test performed at 1,100° C. for 300 hours. FIG. 6 depicts a micrograph of the sample of Example 11 taken in the same manner. It can be seen from FIG. 5 and FIG. 6 that the modified layer was considerably reduced in Examples 8, 10, and 11.

Figure 7:
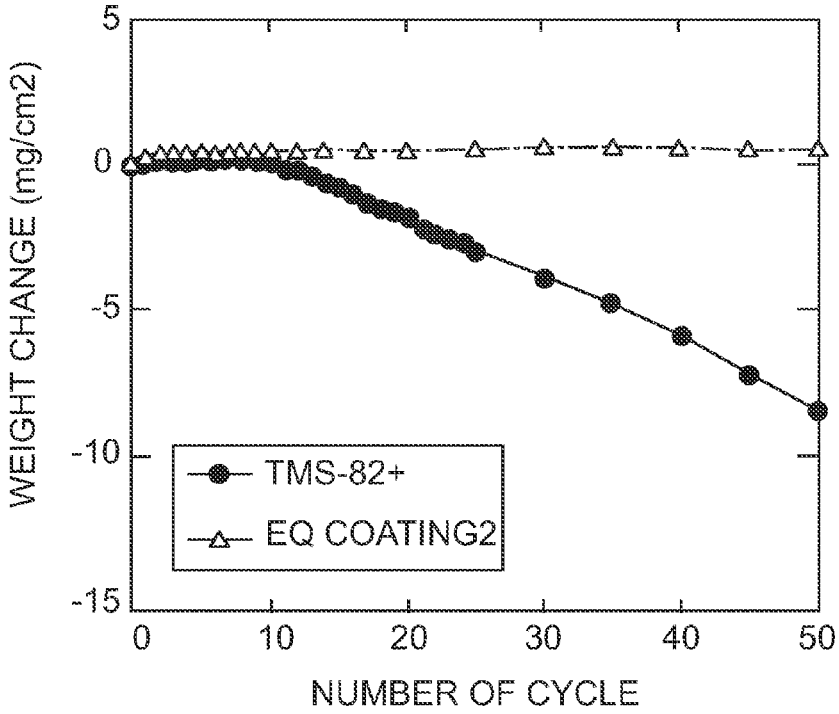
FIG. 7 is a diagram representing the result of an oxidation test conducted at 1,100° C. for 1 hour on the sample obtained in Example 2, along with the result for a Ni-base superalloy used as the substrate.

FIG. 7 is a diagram representing the result of an oxidation test conducted at a cycle of 1,100° C. for 1 hour on the sample (EQ Coating 2) obtained in Example 2, along with the result for the Ni-base superalloy (TMS-82+) used as the substrate. The sample obtained in Example 2 exhibited a superior oxidation resistance compared with the substrate, making it possible to provide a heat-resistant member that has both oxidation resistance and stability, and excels in high-temperature durability.

Examples 16 to 37

Tables 7 and 8 show compositions of additional samples of Ni-base superalloy substrates and coating materials. All numbers are percentage by mass. The Ni-base superalloy substrate samples shown in Table 7 were coated with the coating material samples shown in Table 8, and the thickness of the modified layer was measured after heating and retaining the samples at 1,100° C. for 300 hours. The results are shown in Table 9.

In Examples 16 to 27, 36 and 37, the test was conducted as in Examples 1 to 15, using diffusion couples of the substrate and the coating material prepared as above.

In Examples 28 to 35 and Conventional Techniques 5 to 10, tests were conducted using samples prepared as follows. The substrate of each different composition shown in Table 7 was prepared by casting a sine-crystal alloy rod (ø 10×130 mm) using a directional solidification technique in a vacuum. After a solidification heat treatment, the surface was polished, and finished with an Emery paper (# 600).

The substrate so obtained was coated with the coating material (about 50 μm) using a vacuum plasma spraying method, and was retained at 1,100° C. for 300 hours in an atmosphere. After the test, the cross section was observed with a scanning electron microscope (SEM) to measure the thickness of the modified layer at the coating/substrate interface. The samples were also analyzed with regard to the diffusion state of the elements, using an electron probe microanalyzer (EPMA), and the equilibrium state was evaluated.

TABLE 7

| | Ni | Co | Cr | Mo | W | Al | Ti | Ta | Hf | Re | Ru | Nb |
|---|---|---|---|---|---|---|---|---|---|---|---|---|
| René N5 | Bal. | 8 | 7 | 2 | 5 | 6.2 | 0 | 7 | 0.2 | 3 | 0 | 0 |
| CMSX-10 | Bal. | 3 | 2 | 0.4 | 5 | 5.7 | 0.2 | 8 | 0.03 | 6 | 0 | 0.1 |
| TMS-138A | Bal. | 5.8 | 3.2 | 2.8 | 5.6 | 5.7 | 0 | 5.6 | 0.1 | 5.8 | 3.6 | 0 |
| TMS-173 | Bal. | 5.6 | 2.8 | 2.8 | 5.6 | 5.6 | 0 | 5.6 | 0.1 | 6.9 | 5 | 0 |
| TMS-196 | Bal. | 5.6 | 4.7 | 2.4 | 4.9 | 5.7 | 0 | 5.4 | 0.1 | 6.2 | 5 | 0 |
| TMS-1961 | Bal. | 5.6 | 4.7 | 2.4 | 4.9 | 5.7 | 0 | 4.7 | 0.1 | 6.2 | 5 | 0.5 |

TABLE 8

| | Ni | Co | Cr | Mo | W | Al | Ti | Ta | Hf | Re | Ru | Nb | Si | Y |
|---|---|---|---|---|---|---|---|---|---|---|---|---|---|---|
| Coating A | Bal. | 4.2 | 1.5 | 1.5 | 5.3 | 7.8 | 0 | 8 | 0.15 | 2.6 | 3.9 | 0 | 0 | 0 |
| Coating B | Bal. | 0 | 5 | 0 | 0 | 10 | 0 | 0 | 0 | 0 | 0 | 0 | 0 | 0 |
| Coating C | Bal. | 0 | 5 | 0 | 0 | 10 | 0 | 3 | 0 | 0 | 0 | 0 | 0 | 0 |
| Coating D | Bal. | 0 | 0 | 0 | 0 | 12.7 | 0 | 0 | 0 | 0 | 0 | 0 | 0 | 0 |
| Coating E | Bal. | 4.2 | 1.5 | 1.5 | 5.3 | 7.8 | 0 | 8 | 0.15 | 2.6 | 3.9 | 0 | 1 | 0 |
| Coating F | Bal. | 4.2 | 1.5 | 1.5 | 5.3 | 7.8 | 0 | 8 | 0.15 | 2.6 | 3.9 | 0 | 0.5 | 0 |
| Coating G | Bal. | 4.2 | 1.5 | 1.5 | 5.3 | 7.8 | 0 | 8 | 0.15 | 2.6 | 3.9 | 0 | 0.1 | 0 |
| Coating H | Bal. | 4.2 | 1.5 | 1.5 | 5.3 | 7.8 | 0 | 8 | 0.15 | 2.6 | 3.9 | 0 | 0 | 1 |
| Coating I | Bal. | 4.2 | 1.5 | 1.5 | 5.3 | 7.8 | 0 | 8 | 0.15 | 2.6 | 3.9 | 0 | 0 | 0.5 |
| Coating J | Bal. | 4.2 | 1.5 | 1.5 | 5.3 | 7.8 | 0 | 8 | 0.15 | 2.6 | 3.9 | 0 | 0 | 0.1 |
| Coating K | Bal. | 4.2 | 1.5 | 1.5 | 5.3 | 7.8 | 0 | 6.7 | 0.15 | 2.6 | 3.9 | 0.4 | 0 | 0.5 |
| Coating L | Bal. | 6.1 | 3.7 | 1 | 4.8 | 8.1 | 0 | 9.2 | 0.3 | 0 | 0 | 0 | 0 | 0.1 |
| Coating M | Bal. | 6.1 | 4 | 1 | 4.6 | 8.3 | 0 | 9.7 | 0.3 | 0 | 0 | 0 | 0 | 0.5 |
| Coating N | Bal. | 3.4 | 0.7 | 0.8 | 5.1 | 9 | 0 | 9.4 | 0.15 | 0 | 3.3 | 0 | 0 | 0.04 |
| Coating O | Bal. | 5.4 | 0.9 | 1.1 | 3.7 | 10.6 | 0 | 5 | 0.15 | 0.6 | 5.1 | 0 | 0 | 0.04 |
| Coating P | Bal. | 6.2 | 4 | 1 | 4.5 | 8.1 | 0 | 9.9 | 0.4 | 0 | 0 | 0 | 0 | 0.1 |
| Amdry 9954 | 32 | Bal. | 21 | 0 | 0 | 8 | 0 | 0 | 0 | 0 | 0 | 0 | 0 | 0.5 |

TABLE 9

| | Coating | Substrate | Thickness of modified layer |
|---|---|---|---|
| Example 16 | Coating A | TMS-173 | 1 μm or less |
| Example 17 | Coating B | TMS-173 | 10 μm |
| Example 18 | Coating C | TMS-173 | 5 μm |
| Example 19 | Coating D | TMS-173 | 14 μm |
| Example 20 | Coating E | TMS-173 | 1 μm or less |
| Example 21 | Coating F | TMS-173 | 1 μm or less |
| Example 22 | Coating G | TMS-173 | 1 μm or less |
| Example 23 | Coating H | TMS-173 | 1 μm or less |
| Example 24 | Coating I | TMS-173 | 1 μm or less |
| Example 25 | Coating J | TMS-173 | 1 μm or less |
| Example 26 | Coating J | TMS-1961 | 5 μm |
| Example 27 | Coating K | TMS-173 | 1 μm or less |
| Example 28 | Coating L | René N5 | 1 μm or less |
| Example 29 | Coating L | TMS-138 | 20 μm |
| Example 30 | Coating L | TMS-138A | 20 μm |
| Example 31 | Coating L | TMS-173 | 25 μm |
| Example 32 | Coating L | TMS-196 | 25 μm |
| Example 33 | Coating L | CMSX-10 | 25 μm |
| Example 34 | Coating M | René N5 | 1 μm or less |
| Example 35 | Coating M | TMS-138A | 20 μm |
| Example 36 | Coating N | TMS-173 | 35 μm |
| Example 37 | Coating O | TMS-173 | 10 μm |
| Conventional Technique 5 | Amdry 9954 | René N5 | 120 μm |
| Conventional Technique 6 | Amdry 9954 | TMS-138 | 160 μm |
| Conventional Technique 7 | Amdry 9954 | TMS-138A | 165 μm |
| Conventional Technique 8 | Amdry 9954 | TMS-173 | 174 μm |
| Conventional Technique 9 | Amdry 9954 | TMS-196 | 178 μm |
| Conventional Technique 10 | Amdry 9954 | CMSX-10 | 165 μm |

As is clear from Table 9, the modified layer is considerably thinner in the Examples than in the reference examples in which the existing coating material is used for the coating. This confirms that the diffusion at the coating/substrate interface is inhibited.

There is a considerable reduction in the thickness of the modified layer compared with the coating materials of the Conventional Techniques. More specifically, in the coating of Example 16, all the elements are in a state of thermodynamic equilibrium, and the modified layer was almost unobservable (1 μm or less).

A considerable reduction of the modified layer from the Conventional Techniques was also observed in the coatings of Examples 17 to 19 of the present invention, in which the expensive elements, such as Ru, Ta, Mo, W, and Re, are excluded from the coating, and the chemical potential of Al, which diffuses at the fastest rate and causes the formation of the modified layer, is in a state of thermodynamic equilibrium with the substrate.

In Examples 20 to 27, the elements Si, Y, and Nb were added to the thermodynamically equilibrium composition. The addition of these elements did not have any effect on the growth of the modified layer. This clearly confirms the effect of the present invention.

In Examples 28 and 34, the element Re was excluded from the thermodynamically equilibrium composition, and Y was added. Almost no modified layer is observed in these examples, because the amounts of Re and Y do not have a large effect on the chemical potential of Al, which causes the formation of the modified layer.

In Examples 29 to 33 and 35, the coating materials used in Examples 28 and 34 were applied to the alloy that does not achieve equilibrium with the coating made from these coating materials. Although the diffusion modified layer was observed, because the chemical potential of each element is closer to that of the substrates compared with the coating materials of the Conventional Techniques, the thickness of the modified layer was no more than 25 μm, which is more favorable than the results obtained in Conventional Techniques 5 to 10.

Similarly, in Examples 36 and 37, which used the coating materials that differ from the equilibrium composition of the substrate, the modified layer was thinner than in Conventional Techniques.

Figure 8:
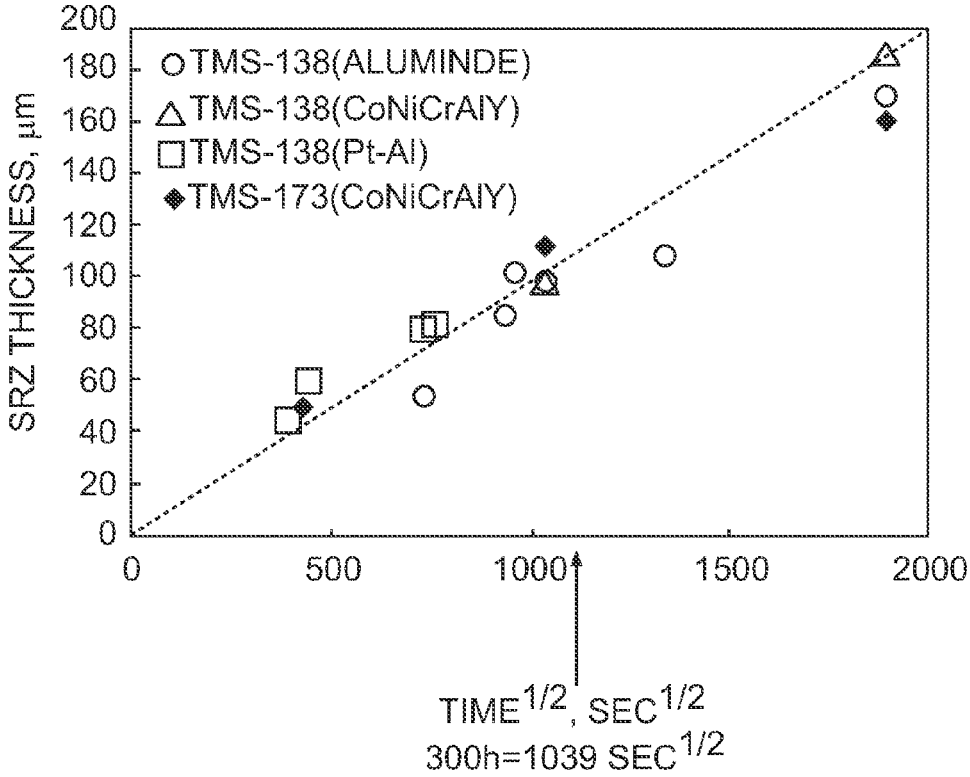
FIG. 8 depicts a graph representing a plot of retention time versus thickness of a deleterious layer (SRZ layer), when Ni-base superalloys coated with existing coatings are retained at 1,100° C.

FIG. 8 represents a thickness of a secondary reaction deleterious layer (Secondary Reaction Zone, SRZ) formed at the coating/substrate interface upon 1,100° C. retention of the Ni-base superalloy treated with the various types of existing coating materials of the Conventional Techniques. It can be seen from the figure that the thickness of SRZ after 300-hour retention can exceed 100 μm. This, combined with the modified layer of several ten micrometers generated in the conventional coatings, creates a modified layer as thick as about 150 μm.

Figure 9:
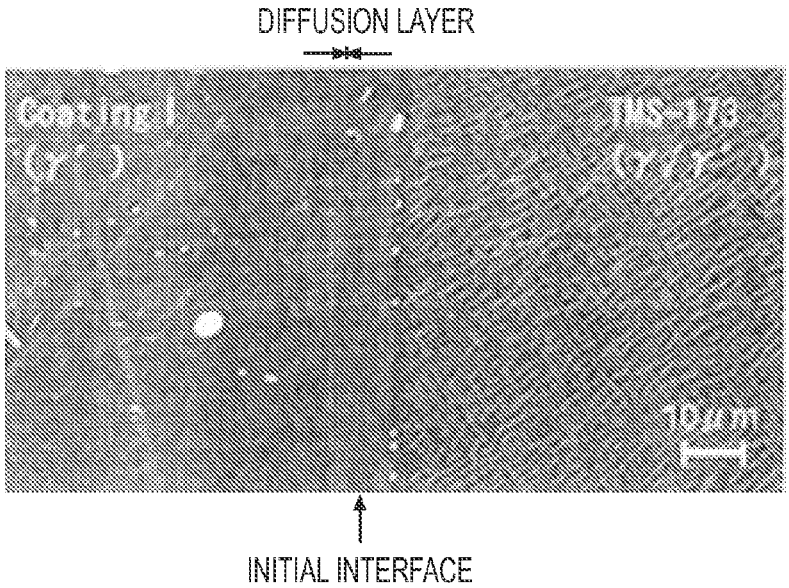
FIG. 9 depicts an enlarged, SEM photograph of the coating/substrate interface of the sample obtained in Example 20, taken after retention at 1,100° C. for 300 hours.

FIG. 9 is an enlarged, SEM photograph of the coating/substrate interface of the sample obtained in Example 20, taken after retention at 1,100° C. for 300 hours. It can be seen from the figure that the technique of the present invention forms substantially no modified layer.

Examples 38 and 39

Figure 10:
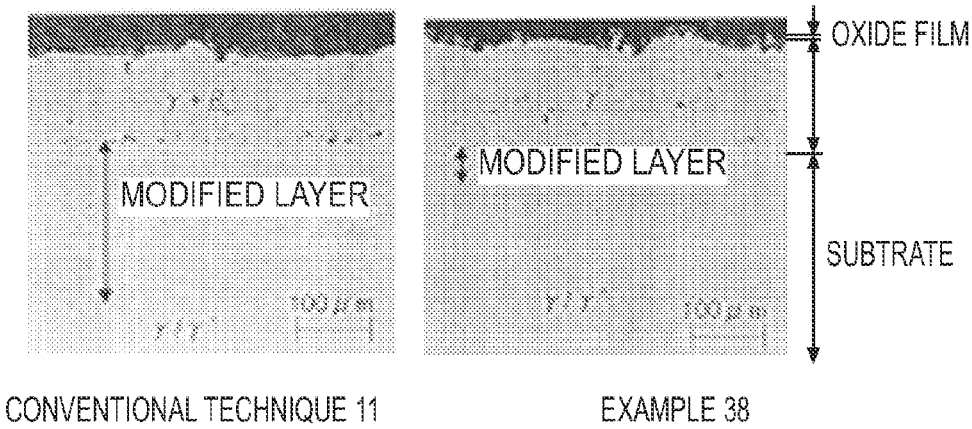
FIG. 10 depicts photographs of the coating/substrate interfaces of Conventional Technique 11 and Example 38, taken after a heating and retaining test performed at 1,100° C. for 300 hours.
Figure 11:
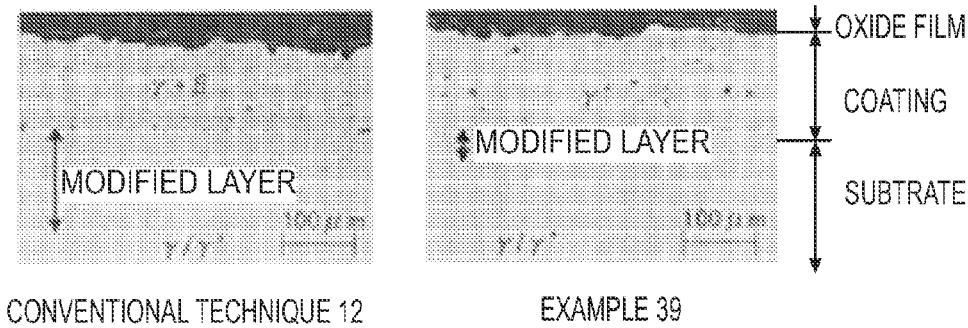
FIG. 11 depicts photographs of the coating/substrate interfaces of Conventional Technique 12 and Example 39, taken after a heating and retaining test performed at 1,100° C. for 300 hours.

Table 10 shows the results of thickness measurement of the modified layer of the coating material formed by high-velocity oxygen fuel spraying, obtained after heating and retaining at 1,100-C for 300 hours. Coating P used in Examples 38 and 39 is substantially the same as Coating L of Example 28. Although this differs from the equilibrium composition of the substrate, because the chemical potential of each element is closer to that of the substrate compared with the coating materials of the Conventional Techniques, the thickness of the modified layer is 40 μm or less. This is considerably thinner than that of the conventional spray coatings of Conventional Techniques 11 and 12. FIG. 10 and FIG. 11 depict micrographs of the coating/substrate interfaces of Examples 38 and 39, and Conventional Techniques 11 and 12, taken after a heating and retaining test performed at 1,100° C. for 300 hours.

Figure 12:
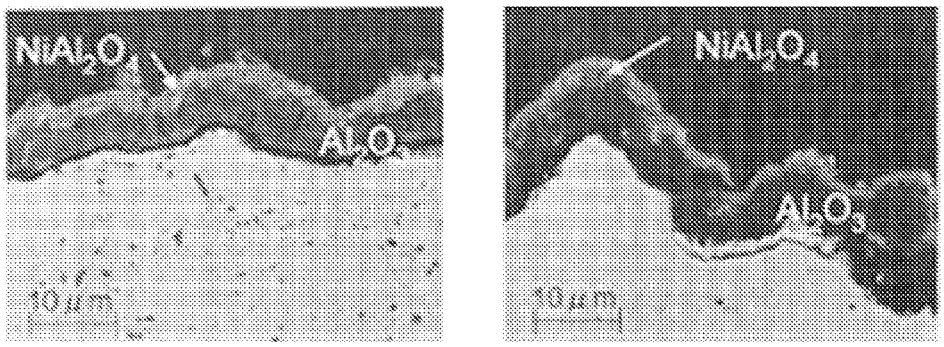
FIG. 12 depicts photographs of the oxide film at the coating surfaces of Conventional Technique 11 and Example 38, taken after a heating and retaining test performed at 1,100° C. for 300 hours in an atmosphere.

FIG. 12 depicts photographs showing a cross section of the oxide film formed on the coating surface of Example 38 and Conventional Technique 11, taken after a heating and retaining test performed at 1,100° C. for 300 hours in an atmosphere. The structure and thickness of the oxide film are substantially the same between the Example and the Conventional Technique, confirming that the oxidation-resistant coating of the Example has properties comparable to the Conventional Technique.

TABLE 10

| | Coating | Substrate | Thickness of modified layer |
|---|---|---|---|
| Example 38 | Coating P | TMS-138A | 40 μm |
| Example 39 | Coating P | TMS-196 | 40 μm |
| Conventional technique 11 | Amdry 9954 | TMS-138A | 230 μm |
| Conventional technique 12 | Amdry 9954 | TMS-196 | 155 μm |

Examples 40

Figure 13:
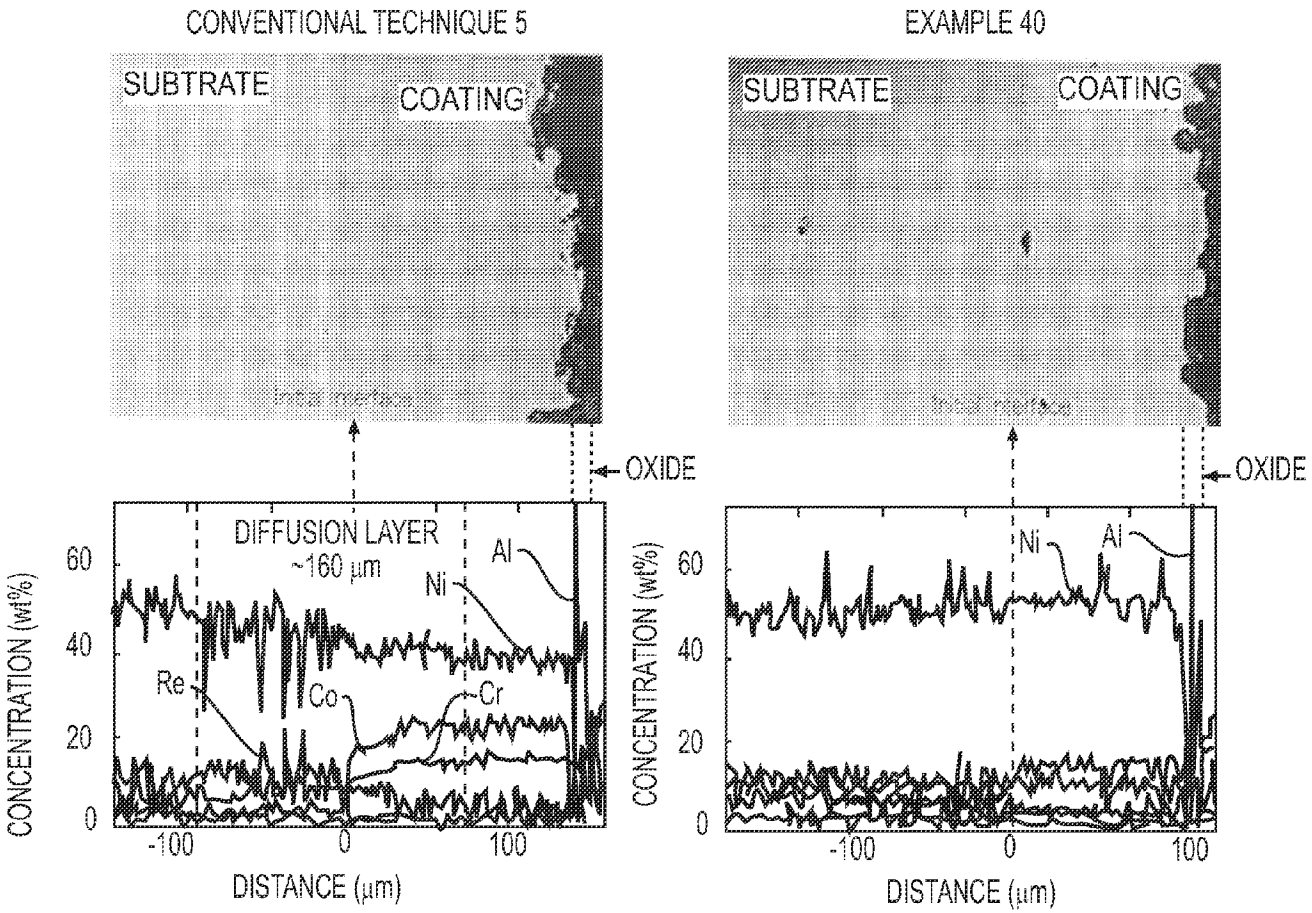
FIG. 13 depicts graphs representing the results of EPMA element analysis, along with photographs of the coating/substrate interfaces of Conventional Technique and Example 40, taken after a heating and retaining test performed at 1,100° C. for 300 hours.

FIG. 13 shows the results of concentration distribution analysis of the coating materials of Table 11 formed by vacuum plasma spraying, conducted using energy-dispersive X-ray spectroscopy after heating and retaining at 1,100° C. for 300 hours. Coating P was prepared from alloy Rene' N5, by removing Re from γ' and adding Y. As can be seen from the concentration distribution of Example 40, almost no interdiffusion occurs at the interface, suggesting that the removal of Re and the addition of Y have no effect on diffusion. This is in contrast to Conventional Technique 5, in which a diffusion layer of about 160 μm thick was observed in the result of concentration analysis.

TABLE 11

| | Coating | Substrate | Thickness of modified layer |
|---|---|---|---|
| Example 40 | Coating P | Rene' N5 | 0 μm |
| Conventional Technique 5 | Amdry 9954 | Rene' N5 | 160 μm |

Example 41

Table 12 shows the creep life of alloys with and without the coating formed by high-velocity oxygen fuel spraying. The creep condition is 1,100° C./137 MPa. The test piece was a flat plate having a thickness of 1 mm and a width of 3 mm. In the conventional coating, the creep life shortened by the formation of the modified layer, whereas, in Example 41, the modified layer was not formed, and the creep life was comparable to that of the exposed material that had no coating.

TABLE 12

| | Coating | Substrate | Creep life |
|---|---|---|---|
| Example 41 | Coating P | TMS-138 | 395.8 h |
| Reference | — | TMS-138 | 411.3 h |
| Conventional Technique 6 | Amdry 9954 | TMS-138 | 189.5 h |

The invention claimed is:

1. A heat-resistant member comprising a Ni-base superalloy substrate coated with at least one coating substance, wherein the coating substance is an alloy material that contains, in mass %, from 6.1% to 10.6% Al, from 0.4% to 4.0% Cr and Ni, as essential components, wherein the Ni-base superalloy substrate and the coating substance have an aluminum chemical potential difference of 10% or less at 1,100° C. and wherein the Ni-base superalloy substrate and the coating substance are in a state of thermodynamic equilibrium.

2. The heat-resistant member according to claim 1, wherein the substrate and the coating substance are made of such material that a diffusion modified layer at a coating interface has a thickness of 70 μm or less after heating and retaining at 1,100° C. for 300 hours.

3. The heat-resistant member according to claim 2, wherein the substrate and the coating substance are made of such material that the diffusion modified layer has a thickness of 50 μm or less.

4. The heat-resistant member according to claim 3, wherein the substrate and the coating substance are made of such material that the diffusion modified layer has a thickness of 40 μm or less.

* * * * *